US010004337B2

(12) United States Patent
Grove

(10) Patent No.: US 10,004,337 B2
(45) Date of Patent: Jun. 26, 2018

(54) LUMBAR STIMULATION DEVICE FOR A CHAIR

(71) Applicant: James E. Grove, Marina Del Rey, CA (US)

(72) Inventor: James E. Grove, Marina Del Rey, CA (US)

( * ) Notice: Subject to any disclaimer, the term of this patent is extended or adjusted under 35 U.S.C. 154(b) by 419 days.

(21) Appl. No.: 14/959,994

(22) Filed: Dec. 4, 2015

(65) Prior Publication Data

US 2017/0156501 A1 Jun. 8, 2017

(51) Int. Cl.

| | |
|---|---|
| ***A47C 7/46*** | (2006.01) |
| ***A47C 7/44*** | (2006.01) |
| ***A61H 15/00*** | (2006.01) |

(52) U.S. Cl.

CPC ..... *A47C 7/465* (2013.01); *A47C 7/44* (2013.01); *A61H 15/00* (2013.01); *A61H 2015/0021* (2013.01); *A61H 2201/0149* (2013.01); *A61H 2201/1253* (2013.01); *A61H 2201/1669* (2013.01); *A61H 2201/1695* (2013.01); *A61H 2205/081* (2013.01)

(58) Field of Classification Search

CPC ..... A47C 7/465; A47C 7/44; A61H 15/00
USPC ..... 297/284.4, 284.7, 284.3
See application file for complete search history.

(56) References Cited

U.S. PATENT DOCUMENTS

| | | | | |
|---|---|---|---|---|
| 3,929,374 | A * | 12/1975 | Hogan | A47C 1/036 297/284.4 |
| 6,938,956 | B1 * | 9/2005 | Piretti | A47C 7/38 297/284.7 |
| 8,764,110 | B2 * | 7/2014 | Hsuan-Chin | A47C 7/44 297/284.7 |
| 9,192,234 | B2 * | 11/2015 | Grove | A47C 1/033 |
| 2009/0115235 | A1 * | 5/2009 | Bock | A47C 7/462 297/284.7 |

* cited by examiner

*Primary Examiner* — Anthony D Barfield
(74) *Attorney, Agent, or Firm* — Morland C. Fischer

(57) ABSTRACT

A lumbar device located inside the back of a chair that tilts back and forth as a user shifts his weight in the chair. The lumbar stimulation device includes sets of back massaging rollers to apply a focused pressure and improve the circulation of blood flowing through the lower back of the user. The lumbar stimulation device is attached to a flexible strap that extends substantially vertically inside the chair had. One end of the flexible strap is affixed to the chair base below the chair seat. The opposite end of the strap is bent backwards when the chair back tilts backwards. When the user leans back, the back of the chair will be pushed downwardly with respect to the strap and the lumbar stimulation device attached to the strap to make it appear to the user that the back massaging rollers of the lumbar stimulation device are moving upwardly along his back.

20 Claims, 8 Drawing Sheets

LUMBAR STIMULATION DEVICE FOR A CHAIR

BACKGROUND OF THE INVENTION

1. Field of the invention

This invention relates to a lumbar stimulation device that is located inside the back of a chair that rocks back and forth between upright and reclined positions as a user shifts his weight in the chair. The lumbar stimulation device is attached to a flexible strap that extends vertically within the back of the chair. When the user leans back, the chair back is pushed downwardly relative to the vertical strap and the lumbar stimulation device attached thereto to make it appear to the user that the lumbar stimulation device is moving upwardly along his back.

2. Background Art

An individual who is seated in a chair may wish to have a focused pressure applied from the back of the chair to a lower (i.e., lumbar) region of his back to enhance his comfort while seated. In addition to enhancing his comfort, applying a focused pressure to the lower back may stimulate or increase the circulation of blood flow. A conventional chair has no moving parts in the back and, therefore, is incapable of generating a focused pressure to be applied to the lower back of the seated individual. That is, because of the static nature of a typical chair back, especially those common to chairs having a back which reclines when the individual shifts his weight backwards, the individual may experience discomfort in his lower back when he remains seated for a long time. Although electrically powered external attachments are known to be used in combination with a chair back to massage an individual's back, such attachments are frequently expensive, require a source of electrical power to operate, and can become separated from the chair back and misplaced.

Therefore, what would be desirable is a chair having a back that tilts back when a user shifts his weight backwards and within which a lumbar stimulation device is located to apply a focused pressure to the user's lower back without first having to be attached to the chair back or operated from an electrical power source.

SUMMARY OF THE INVENTION

In general terms, a lumbar stimulation device is disclosed to be located inside the back of a chair that rocks back and forth between upright and reclined positions as a user shifts his weight back and forth in the chair. The lumbar stimulation device is capable of applying a focused pressure and improving the circulation of blood flowing through the lower back of the user seated in the chair and leaning backwards. The chair with which the lumbar stimulation device is associated includes a seat that is held above the ground by a base. A gas cylinder that extends between a gas cylinder receiver of the base and a seat plate at the bottom of the seat is operable to adjust the elevation of the seat above the base. The chair also includes a rigid (e.g., plywood) backing that runs through the rear of the chair back and an upholstered cover that lies opposite the rigid backing at the front of the chair back.

The lumbar stimulation device located inside the back of the chair has upper and lower roller carriages that are spaced one above the other and rotatable relative to one another. A flexible strap runs generally vertically through the chair back alongside the rigid backing. A lower end of the strap is affixed to the gas cylinder of the chair base by means of a substantially stationary strap attachment which runs below the chair seat. The lumbar stimulation device is attached to the flexible strap by means of a lumbar stimulation device coupler. The opposite upper end of the flexible strap within the chair back bends backwards as the chair back tilts backwards. When the user leans back in the chair, the rigid backing and the front cover of the chair back are pushed by the user's back downwardly towards the chair base relative to the vertical strap and the lumbar stimulation device attached thereto. That is, the vertical position of the strap and the lumbar stimulation device with respect to the chair base remains stationary to make it appear to the user that the stimulation device is moving upwardly along his back.

Each of the upper and lower roller carriages of the lumbar stimulation device has a set of (e.g., four) back massaging rollers that are partially received and rotatable within respective cavities. Each back massaging roller has a plurality of hard nubs projecting therefrom to apply a focused pressure and thereby massage the back of the user. The flexible strap to which the lumbar stimulation device is attached is clamped between the lumbar stimulation device coupler and a wheel housing having a pair of wheels that lie in contact with and roll on the rigid backing when the chair back tilts backward, the flexible strap is correspondingly bent backwards, and the rigid backing and front cover of the chair back move downwardly relative to the lumbar stimulation device. An optional pressure control fabric lies over the lumbar stimulation device to receive the user's back thereagainst when the user leans back in the chair. A control knob is accessible at one side of the chair back to be rotated by the user by which to rotate a control shaft that is coupled to one side of the fabric. By rotating the control knob, the user will be able tip selectively control the tightness of the pressure control fabric. In this manner, the user can adjust the distance between his back and the upper and lower roller carriages of the lumbar stimulation device so as to correspondingly adjust the pressure to be applied to his back by the back massaging rollers of the roller carriages.

DESCRIPTION OF THE PREFERRED EMBODIMENT

Figure 1:
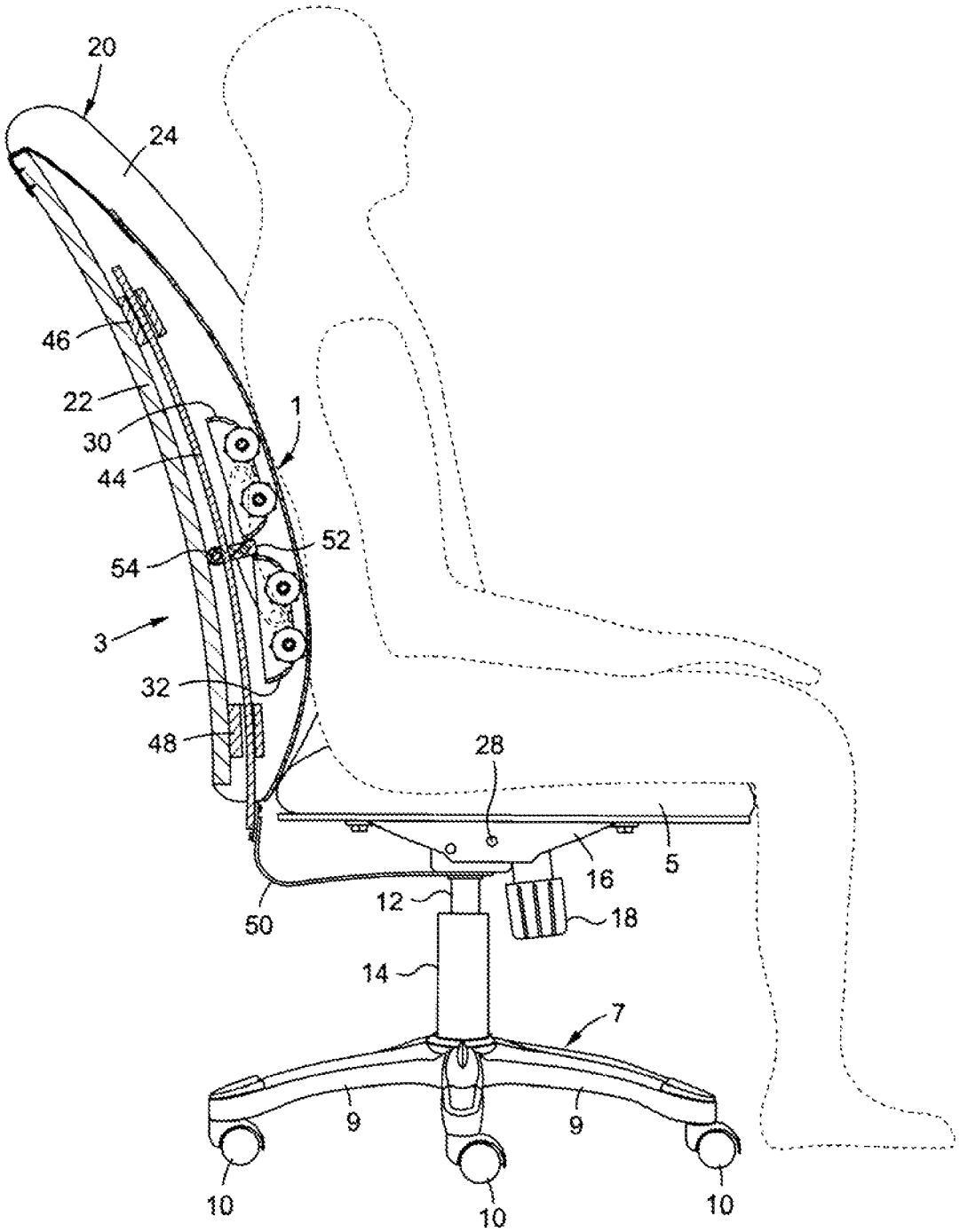
FIG. 1 shows a chair having a seat, a back and a lumbar stimulation device according to a preferred embodiment of this invention located inside the chair back and positioned relative to the back of a user when the chair back tilts forwards to an upright position.
Figure 2:
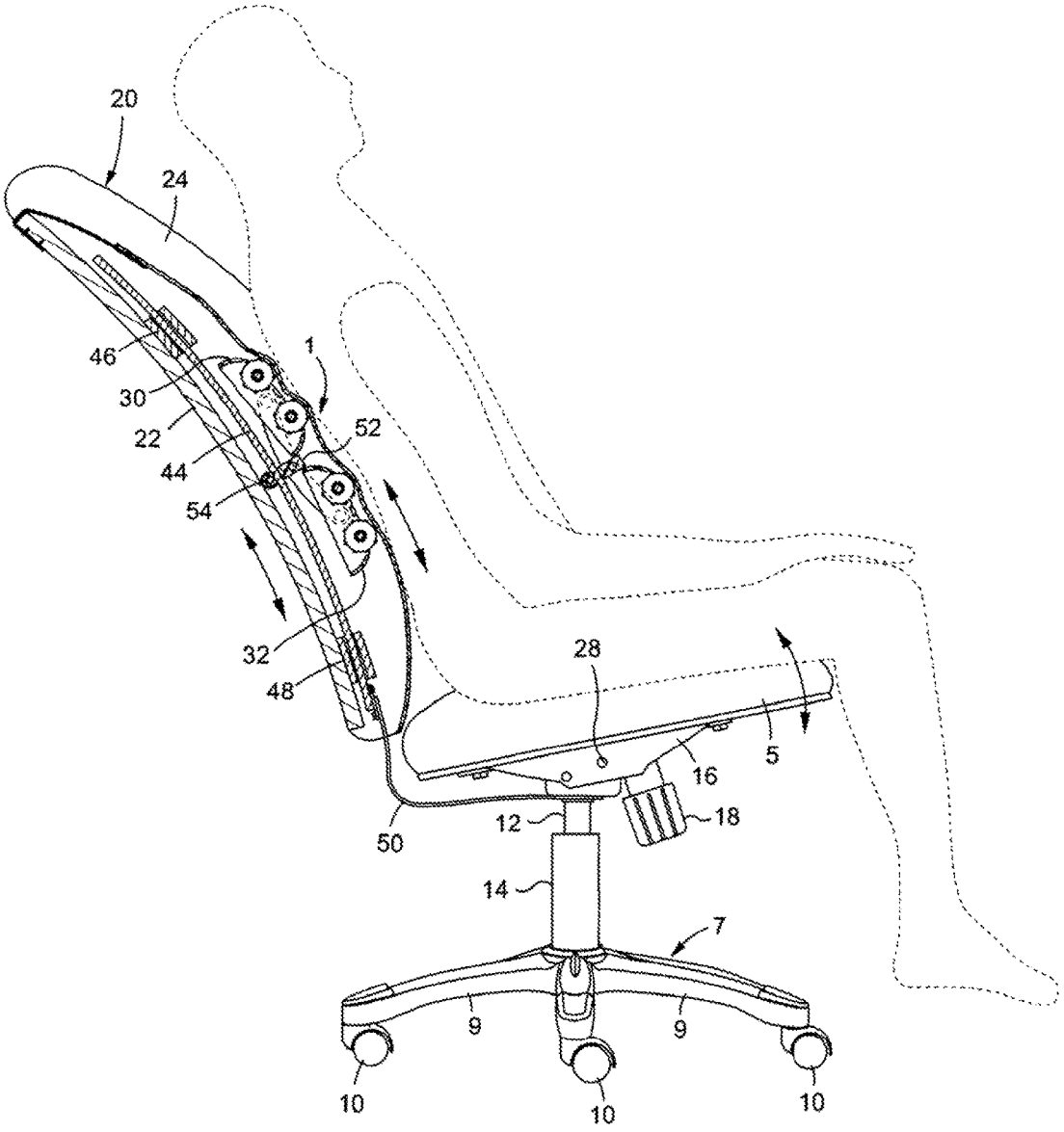
FIG. 2 shows the chair of FIG. 1 with the lumbar stimulation device that is located inside the chair back positioned relative to the back of the user when the chair back tilts backwards to a reclined position.

Referring initially to FIGS. 1 and 2 of the drawings, a preferred embodiment is described for a lumbar stimulation device 1 for a chair in accordance with the present invention. As will soon be explained, the lumbar stimulation device 1 is capable of applying a focused pressure and improving the circulation of blood flowing through the lower back (e.g. the lumbar area) of one seated in a chair with which the lumbar stimulation device of this invention is associated. Thus, the well-being of the individual seated in the chair may be improved.

The chair 3 with which the lumbar stimulation device 1 is associated is one that tilts as the user shifts his weight in the chair. The chair 3 is of the kind that would commonly be found in a home or office. As in many chairs, the chair 3 includes a seat 5 that is held above the ground by a base 7 having a set of legs 9 to which rollers 10 are attached to permit the chair 3 to be rolled over a flat surface. A gas cylinder 12 extends between a gas cylinder receiver 14 that stands upwardly from the base 7 and a seat plate 16 that lies below the seat 5 of the chair 3. A lever arm (best shown in FIGS. 6 and 7) cooperates with the gas cylinder 12 to enable the elevation of the seat to be adjusted above the base 7 to suit the needs of the user. An adjustment knob 18 which is accessible below the seat plate 16 is rotated to adjust the spring of the seat 5 depending upon the size and the weight of the user.

The chair 3 also has a back 20 which stands upwardly from the seat 5. The chair back 20 includes a rigid (e.g., plywood) backing 22 at the rear of the back 20, intermediate filler material (not shown), and a conventional upholstered cover 24 at the front of the back 20 that is attached to and lies opposite the rigid backing 22. The back 20 is connected to the seat by a pair of arms (one of which being shown in FIGS. 6 and 7) As the user shills his weight and leans back against the back 20 of the chair 3, the chair will tilt backwards, and the seat 5 and back 20 will simultaneously rotate around a pivot 28 through the seat plate 16. Thus, the chair back 20 rocks back and forth between an upright position shown in FIG. 1 and a reclined position shown in FIG. 2 depending upon whether the user shills his weight backwards or forwards in the chair 3.

The lumbar stimulation device 1 of this invention is located inside the chair back 20 between the rigid backing 22 at the rear of the chair back 20 and the upholstered cover 24 at the front. Referring concurrently to FIGS. 1-5 of the drawings, the lumbar stimulation device 1 is shown having an upper (e.g., plastic roller carriage 30 and a lower (e.g., plastic) roller carriage 32. The upper and lower roller carriages 30 and 32 are held in spaced end-to-end alignment one above the other by a pair of (e.g., metal) arched side plates 34 and 36 (best shown in FIGS. 3 and 5) which are retained at the opposite sides of the roller carriages by pairs of axially aligned pivot pins 38 and 40. The pairs of pivot pins 38 and 40 establish pivot axes around which the roller carriages 30 and 32 are rotatable relative to and independently of one another.

A flexible strap 44 having a spring memory arras generally vertically through the chair back 20 alongside and spaced from the rigid backing 22. An upper strap support sleeve 46 is affixed (e.g., screwed) to the backing 22 to surround and position the upper end of the strap 44 adjacent the backing at the top of the chair back 20. A lower strap support sleeve 48 is also affixed to the backing 22 to surround and position the opposite lower end of the strap 44 adjacent the backing at the bottom of the chair back 20. As will soon be described, the flexible strap 44 bends backwards in response to the user leaning back in the chair 3 and the chair back 20 correspondingly tilting back from its upright position of FIG. 1. to its reclined position of FIG. 2.

Located below the seat plate 16 of the chair 3 is a relatively stiff strap attachment 50. One end of the strap attachment 50 is attached to the chair base 7 in surrounding engagement with the gas cylinder 12. The opposite end of the strap attachment 50 turns upwardly towards and is affixed to the lower end of the strap 44 at the bottom of the chair back 20. The strap attachment 50 remains substantially stationary as the chair seat 5 and the chair back 20 rock back and forth with one another at the pivot 28 (of FIGS. 1 and 2). That is, as the chair back 20 tilts backwards and the strap 44 is correspondingly bent backwards therewithin, the strap attachment 50 which attaches the strap 44 to the chair base 7 at the gas cylinder 12 will not be displaced relative to the chair seat 5 below which the attachment 50 runs. What is more, and as will be disclosed in greater detail hereinafter, the rigid backing 22 and the front cover 24 of the chair back 20 are movable vertically (i.e., down and up) with respect to the flexible strap 44, the lower end of which is affixed to the stationary strap attachment 50.

Figure 4:
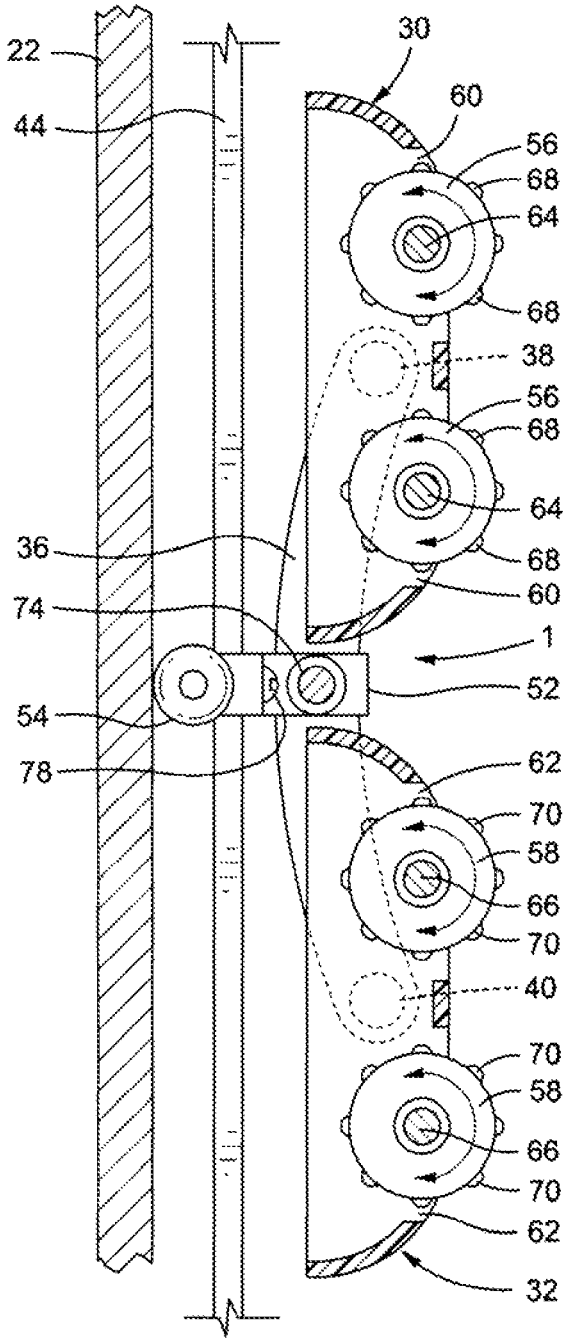
FIG. 4 is a cross-section of the lumbar stimulation device taken along lines 4-4 of FIG. 3.
Figure 5:
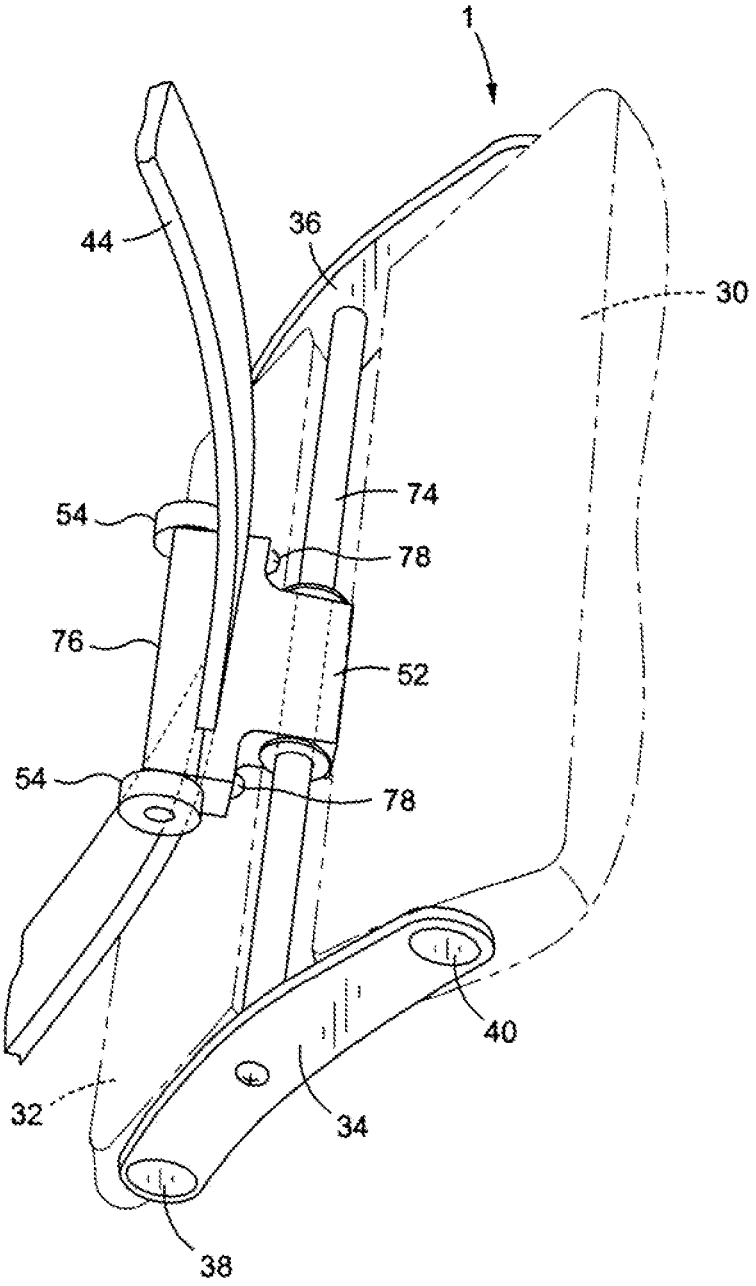
FIG. 5 shows the lumbar stimulation device attached to the flexible strap within the chair back by means of a lumbar stimulation device coupler.

As will also be disclosed in greater detailed hereinafter, the lumbar stimulation device 1 that is located inside the back 20 of the chair 3 is attached to the vertically extending flexible strap 44 within the chair back 20 by means of a lumbar stimulation device coupler 52 (i.e., a mounting block that is best shown in FIGS. 4 and 5). The lumbar stimulation device coupler 52 holds a pair of wheels 54 (also best shown in FIGS. 4 and 5) in contact with the rigid backing 22 within the chair back 20.

With the lower end of the strap 44 attached to the base 7 of the chair 3 by means of the stationary strap attachment 50 which runs below the seat 5, the opposite upper end or the strap 44 is bent backwards and forwards relative to the base 7 in response to the chair back 20 tilting. back and forth as the user shifts his weight. In the case of FIG. 2, when the user leans back and the chair back 20 tilts backwards, the rigid backing 22 and the cover 24 at the rear and the front of the chair back 20 as well as the upper and lower strap support sleeves 46 and 48 affixed to the backing 22 are all pushed downwardly by the force of the user's back towards the strap attachment 50. More particularly, simultaneously with the back 20 of chair 3 tilting backwards, the chair seat 5 will tilt backwards and downwards, the chair back 20 will move downwards relative to the strap 44 such that the distance between the bottom of the chair back 20 and the stationary strap attachment 50 will be shortened, and the flexible strap 44 will bend backwards relative to the chair base 7. It should be appreciated that the strap 44 inside the chair back 20 is held in place by the strap attachment 50 so as to remain substantially stationary in the vertical direction. Therefore, the strap 44 will not move downwardly the rigid backing 22 and the front cover 24 of chair back 20.

Because it is attached to the strap 44 by the lumbar stimulation device coupler 52, the lumbar stimulation device 1 will also remain substantially stationary in the vertical direction when the chair back 20 tilts backwards and moves downwards. Inasmuch as the rigid backing 22 of the chair back 20 moves downwardly relative to the each of the strap 44 and the lumbar stimulation device 1 attached thereto when the user leans back, the wheels 54 of the coupler 52 roll over the downwardly moving backing 22. Accordingly, it will appear to the user leaning against the chair back 20 that the stationary lumbar stimulation device I is moving upwardly along his back to apply a pressure thereto.

When the user leans forward in the chair 3 away from the chair's back 22. the backwardly bent strap 44 with spring memory will automatically bend forwards, and the chair back 22 will rotate to its upright position as shown in FIG. 1. The rigid backing 22 and the front cover 24 of the chair back 20 will move together upwardly relative to the strap 44 so that it will now appear to the user that the lumbar stimulation device 1, which is actually stationary, is moving downwardly along his back.

Figure 3:
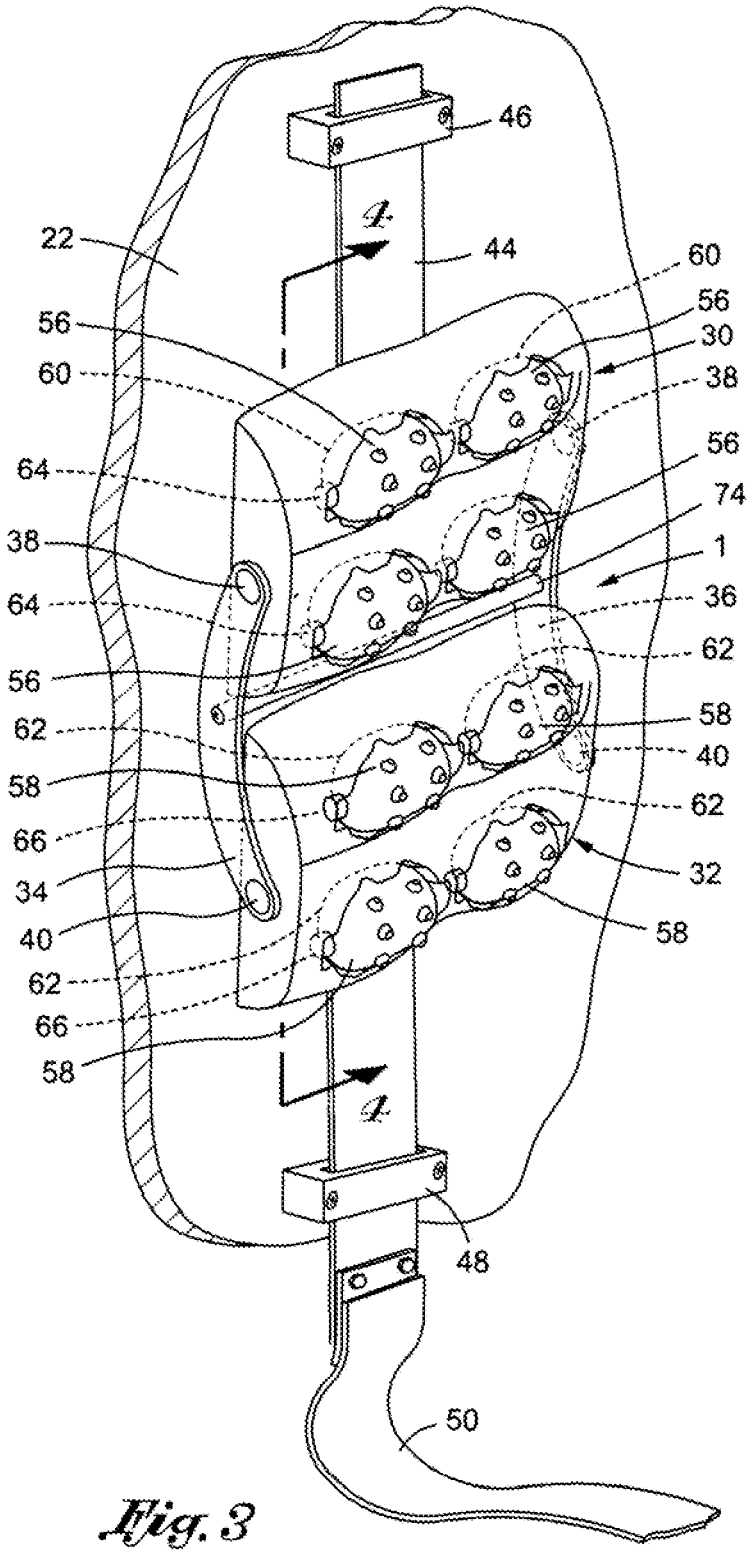
FIG. 3 is an enlarged detail showing the lumbar stimulation device attached to a flexible strap that run generally vertically through the back of the chair that is shown in FIGS. 1 and 2.

Details of the lumbar stimulation device 1 are now disclosed while referring specifically to FIGS. 3-5 of the drawings. As earlier described, the lumbar stimulation device 1 includes upper and lower roller carriages 30 and 32 that are held in spaced end-to-end alignment by a pair of arched side plates 34 and 36 which are connected to opposite sides of the roller carriages 30 and 32 by pairs of axially aligned pivot pins 38 and 40. The lumbar stimulation device 1 is attached to the strap 44 which runs vertically through the back 20 of the chair 3 by means of the lumbar stimulation device coupler 52. As already explained, the pair of wheels 54 of the coupler 52 (best shown in FIG. 5) are held against and roll over the rigid backing 22 as the rigid backing and the front cover 24 of the chair back 20 move downwardly and upwardly relative to the strap 44 as the user rocks back and forth in the chair 3.

Each of the upper and lower roller carriages 30 and 32 carries a set of (e.g., four) identical plastic back massaging rollers 56 and 58. Each of the back massaging rollers 56 and 58 is partially recessed within a respective cavity 60 and 62 formed in the roller carriages 30 and 32. The back massaging rollers 56 and 58 are pivotally connected by axially extending pivot hubs 64 and 66 to the roller carriages 30 and 32 so as to be rotatable in opposite directions within their respective cavities 60 and 62. Each back massaging roller 56 and 58 has a plurality of hard plastic nubs 68 and 70 protecting outwardly therefrom to create focused points of pressure to massage the back and improve the blood circulation of the user reclining in the chair back 20 and leaning against the lumbar stimulation device 1 located therein.

As is best shown in FIG. 5. the lumbar stimulation device coupler 52 includes rotatable rod 74 extending laterally therethrough and lying within a space between the upper and lower roller carriages 30 and 32. The rotatable rod 74 is connected to respective ones of the arched side plates 34 and 36 lying at opposite sides of the upper and lower roller carriages 30 and 32. The rod 74 rotates within the coupler 52 to permit the upper and lower roller carriages 30 and 32 to rotate in unison with rod 74 so that the lumbar stimulation device 1 can be oriented to conform to the shape of the back of the user as he reclines in the chair back against the lumbar stimulation device 1 and the back massaging rollers 54 and 56 thereof.

Also best shown in FIG. 5 is the lumbar stimulation device coupler 52 attached to the flexible strap 44 which mans vertically through the back 20 of the chair 3. Because the lumbar stimulation device 1 is attached to the coupler 52 at the rotatable rod 74 which extends laterally through the coupler and between the plates 34 and 36, the lumbar stimulation device 1 is likewise attached to the strap 44 and held substantially stationary therewith in the vertical direction (relative to the strap attachment 50 of FIGS. 1-3) as the rigid backing 22 and the front cover 24 of the chair back 20 move downwardly and upwardly.

The pair of wheels 54 of the lumbar stimulation device coupler 52 which are held against and roll on the rigid backing 22 (of FIGS. 3 and 4) as the chair back 20 (of FIGS. 1 and 2) tilts backwards and forwards are carried at opposite sides of and rotatable relative to a wheel housing 76. The wheel housing 76 is detachably connected to the coupler 52 by a pair of locking bolts 78 such that the strap 44 is held therebetween. In other words, the strap 44 is clamped between the wheel housing 76 and the coupler 52 so that the lumbar stimulation device 1 is attached to the strap 44 acid held substantially stationary in the vertical direction by the strap as the rigid backing 22 and the front cover 24 (also of FIGS. 1 and 2) move downwardly and upwardly with respect o the strap when the chair back 20 tilts backwards and forwards.

FIGS. 6-9 of the drawings illustrate a modified chair 3-1 having a modified chair back 20-1 and an optional pressure control fabric 80 that lies over the lumbar stimulation device 1 of FIGS. 1-5. As will now be explained, one seated in the modified chair 3-1 can selectively adjust the pressure to be applied to his back through the pressure control fabric 80 by the back massaging rollers 56 and 58 that are carried by the upper and lower roller carriages 30 and 32 of the lumbar stimulation device 1. Identical reference numerals are used in FIGS. 6-9 to refer to identical features previously used while describing the chair 3 of FIGS. 1-5.

The pressure control fabric 80 that lies over the lumbar stimulation device 1 of the modified back 20-1 of the modified chair 3-1 is preferably a flexible mesh fabric having a shape and dimensions that enable the fabric to be positioned between the lumbar stimulation device 1 and the back of the seated individual. A longitudinally extending tubular eyelet (designated 82 and best shown in FIGS. 8 and 9) runs along each side of the pressure control fabric 80, and a rigid stiffening rod 84 (only one of which being shown) is received through each tubular eyelet 82 at each side of the fabric. In the alternative, the opposite sides of the fabric 80 can be wrapped around and fastened against respective stiffening rods 84 so that the eyelets 82 can be eliminated.

A pair of generally L-shaped fabric retention brackets 86 are affixed to opposite sides of the rigid (e.g., plywood) backing 22 at the rear of the chair back 20-1. One of a pair of threaded fabric control shafts 88 (only one of which being shown in FIGS. 8 and 9) has a length that is sufficient to extend continuously through a respective bracket 86 for connection to a fabric control knob 90 that lies outside one of the upholstered sides 91 of the modified chair back 20-1 (best shown in FIG. 7). Thus, the knob 90 will be manually accessible to a user at one side of the chair back 20-1. As will soon be explained, a rotation of the fabric control knob 90 will cause a rotation of the control shaft 88 and a corresponding pulling or pushing force applied is one side of the pressure control fabric 80 to control the tightness of the fabric depending upon the direction in which the knob 90 is rotated.

The end of the fabric control shaft 88 (of FIGS. 8 and 9) which lies opposite the fabric control knob 90 is coupled to a threaded nut 92. The threaded nut 92 is preferably manufactured from steel and is sized to receive the threaded fabric control shaft 88 therethrough so that the nut 92 will move axially along the threaded shaft 88 in response to a rotation of the fabric control knob 90. The threaded nut 92 has an enlarged head 94 which extends in a radially outward direction. One of the stiffening rods 84 which runs longitudinally along one of the sides of the pressure control fabric 80 is welded to the head 94 of the threaded nut 92. Accordingly, it may be appreciated that the pressure control fabric 80 is held between the stiffening rods 84 that are welded to the nuts 92 to which perspective fabric control shafts 88 are coupled at opposite sides of the modified chair back 20-1 and at opposite sides of the rigid backing 22 located therewithin.

In the embodiment shown in FIGS. 6-9, a pair of threaded fabric control shafts 88 extend between brackets 86 that are affixed to opposite sides of the rigid backing 22 and respective threaded nuts 92 that are coupled to the opposite sides of the pressure control fabric 80 so that the fabric is suspended between the stiffening rods 84. However, only a single fabric control knob 90 need be attached to a single one of the fabric control shafts 88 (best shown in FIGS. 8 and 9) to be rotated to control the tightness of the fabric 80.

Figure 6:
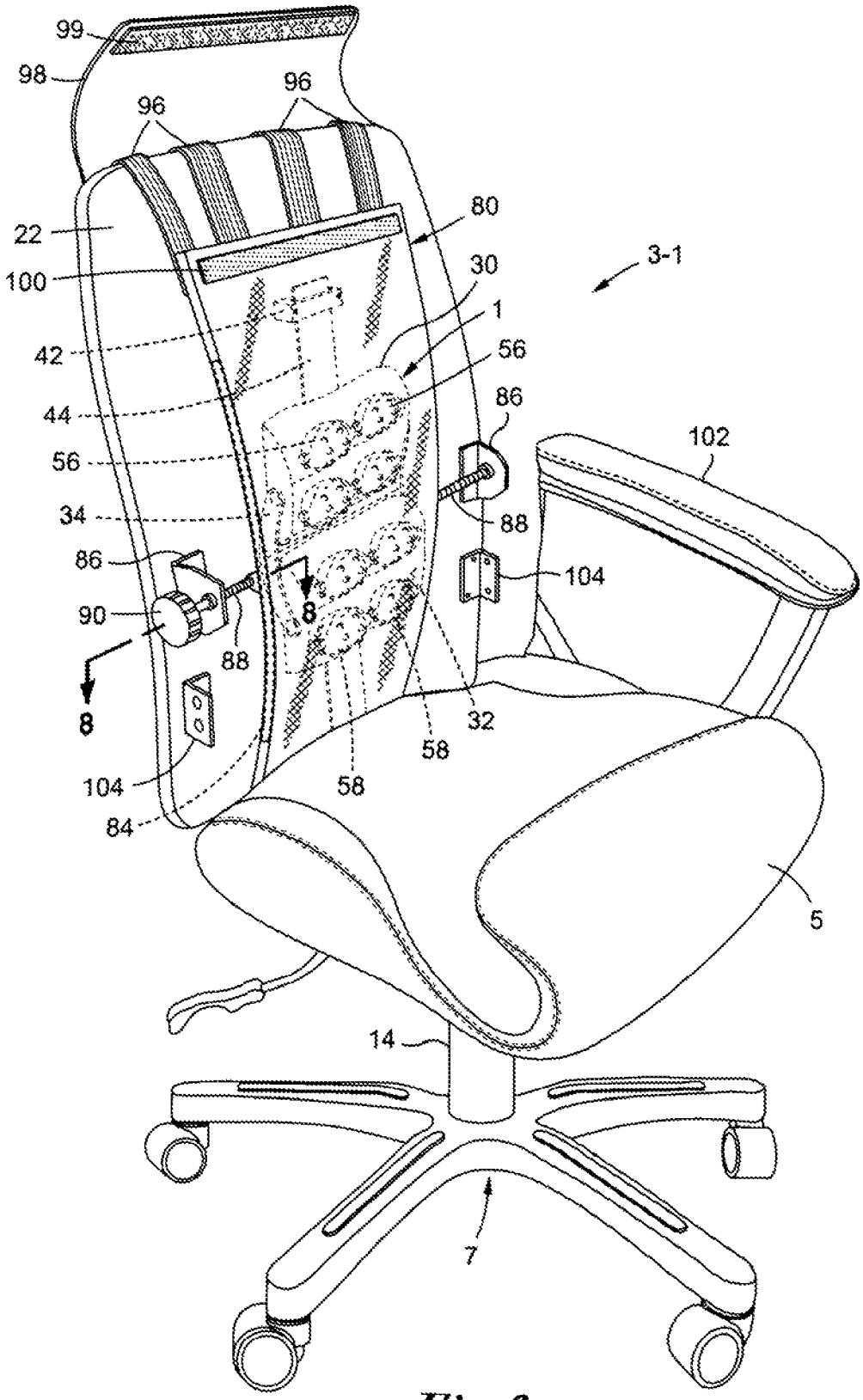
FIGS. 6 and 7 show a modified chair having a modified back and including a flexible pressure control fabric being held at the front of the chair back to cover the lumbar stimulation device located inside the chair back and a control knob at one side of the chair back to be rotated to enable a user to control the of the pressure control fabric, the distance between the lumbar stimulation device and the back of the user reclining against the chair back, and the pressure that is correspondingly applied to the user's back by the lumbar stimulation device.
Figure 7:
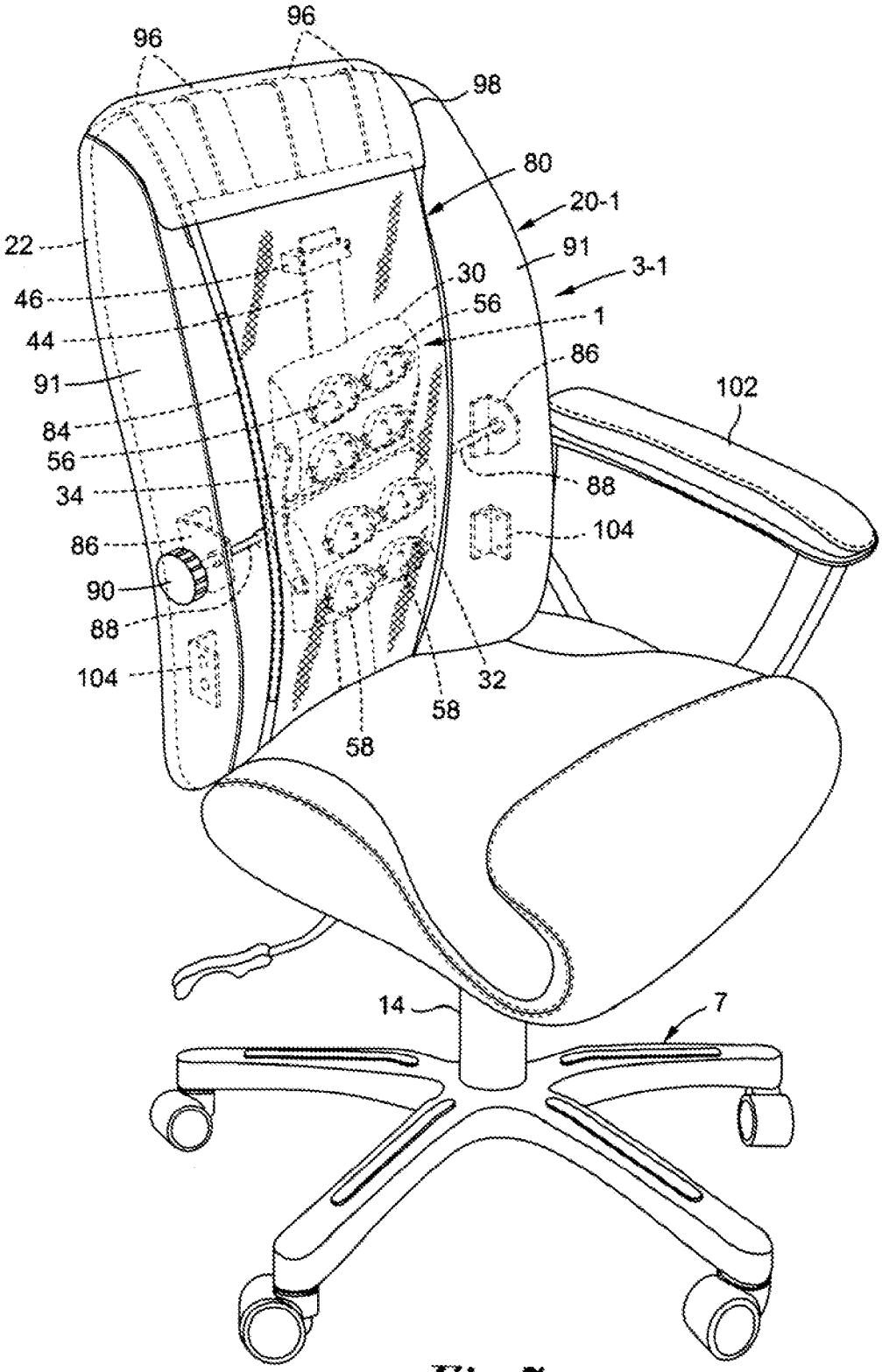
Figure 8:
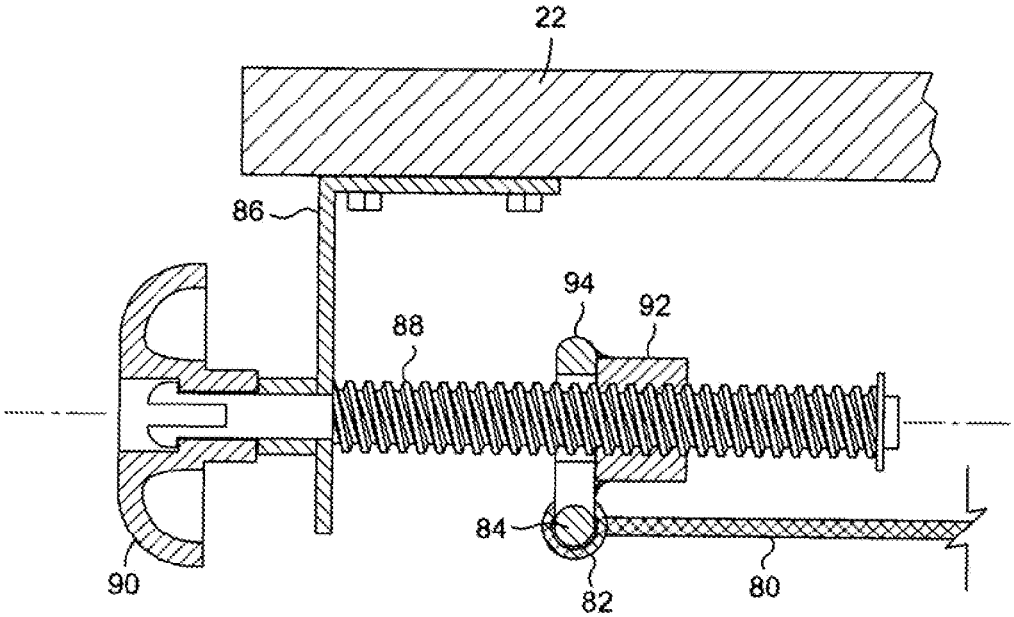
FIG. 8 is a cross section taken along lines 8-8 of FIG. 7 showing the control knob and a bracket for holding the control knob and the flexible pressure control fabric adjacent a rigid backing that is located at the rear of the chair back shown in FIGS. 6 and 7.
Figure 9:
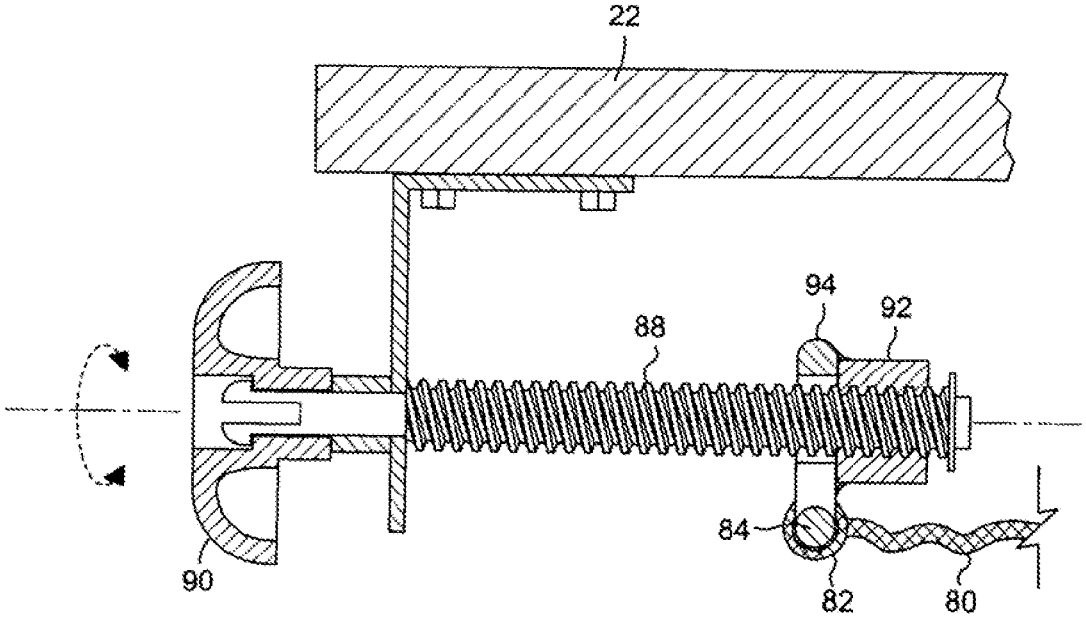
FIG. 9 shows the control knob of FIG. 8 being rotatable in opposite directions to control the of the flexible pressure control fabric and the pressure that is applied to the user's back by the lumbar stimulation device that is covered by the fabric.

As in the case of the back 20 of the chair 3 shown in FIGS. 1 and 2, the lumbar stimulation device 1 of the modified chair back 20-1 of the modified chair 3-1 that is shown in FIGS. 6 and 7 is attached to a flexible strap 44 having a spring memory and holding the lumbar stimulation device 1 substantially stationary in the vertical direction when the chair back tilts back and forth. However, unlike the previously described chair back 20, the modified chair back 20-1 is devoid of filler material between the pressure control fabric 80 at the front of the chair back 20-1 and the rigid backing 22 at the rear of the chair back 20-1. Thus, when the user reclines in the chair 3-1, his back will lay directly on the pressure control fabric 80 which lays over the lumbar stimulation device 1 so that the user can feel the pressure provided by the back massaging rollers 56 and 58 that are carried by the upper and lower roller carriages 30 and 32.

The flexible pressure control fabric 80 is held up by the stiffening rods 84 so as to be spaced from and lie parallel to the rigid backing 22. The pressure control fabric 80 is held in place over the lumbar stimulation device 1 by means of a set of (e.g., four) elastic straps 96 which run over the top of the backing 22 (best shown in FIG. 6). The top of the fabric 80 is attached (e.g., sewn or stapled) to the first ends of the elastic straps 96 that lie adjacent the front and top of the rigid backing 22. The opposite ends of the elastic straps 96 bend over the top of the backing 22 so as to be attached (e.g., stapled) to the rear of backing 22. The bottom of the pressure control fabric 80 is attached stapled) to the front and bottom of the rigid backing 22.

One end of an upholstered foldover flap 98 is attached (e.g., stapled) to the rear of the rigid backing 22. The opposite end of the foldover flap 98 bends over the top of the backing 22 so as to lie at the front of the backing. The aforementioned opposite end of the foldover flap 98 has a strip 99 of book and loop fastener material (best shown in FIG. 6) running therealong. The top of the pressure control fabric 80 has an opposing strip 100 of hook and loop fastener material running therealong. When the foldover flap 98 is folded over the top of the rigid backing 22 as shown in FIG. 6, the opposing strips 99 and 100 of hook and loop fastener material are detachably mated to one another so that at the flap 98 is held down over the elastic straps 96 and against the top of the fabric 80.

The upholstered sides 91 of the modified chair back 20-1 (best shown in FIG. 7) between which the upholstered foldover flap 98 is held extend from the rear of the rigid backing 22 to enclose the lumbar stimulation device 1 and the pressure control fabric 80 which lays thereover. The upholstered sides 91 are held in place by respective ones of the previously described fabric retention brackets 86 that are affixed to opposite sides of the backing 22. The arms 102 (only one of which being shown in FIGS. 6 and 7) of the chair 3-1 are connected between the chair seat 5 and the rigid backing 22 at L-shaped arm brackets 104 which are affixed to the backing 22 below the fabric retention brackets 86.

Rotating the fabric control knob 90 that is accessible outside one side 91 of the modified chair back 20-1 enables the user of the modified chair 3-1 to selectively control how tightly the flexible pressure control fabric 80 is pulled by the stiffening rod 84 that is affixed to the threaded nut 94 located adjacent one side of the rigid backing 22. More particularly, when the control knob 90 is rotated in as first direction, the threaded nut 92 will move axially along the threaded fabric control shaft 88 away from fabric 80. In this case, the pressure control fabric 80 which lays over the lumbar stimulation device 1 will be stretched (best shown in FIG. 8), so that the fabric 80 is made tighter and the user's back which presses against the fabric 80 will be moved away from the back massaging rollers 56 and 58, whereby the back massage pressure experienced by the user will be reduced.

However, when the control knob 90 is rotated in an opposite direction, the threaded nut 92 will move axially along the threaded shaft 88 towards the fabric 80. In this case, one side of the pressure control fabric 80 will be pushed towards the other (best shown in FIG. 9), so that the fabric 80 is now made looser and more relaxed to permit the user's back to move closer to the back massaging rollers 56 and 58 of the lumbar stimulation device 1, whereby the back massage pressure experienced by the user will be increased when the user leans back in the chair back 20-1 in the manner previously described.

The invention claimed is:

1. A chair comprising:

a chair seat to support the weight of a user;

a chair base to hold the chair seat above the ground;

a chair back having a top and a bottom and standing upwardly from the chair seat above the chair base and tilting backwards when the user leans back against the chair back;

a flexible strap having first and opposite ends and extending vertically inside the chair back, the first end of said strap attached to the chair base and the opposite end of said strap bending backwards relative to said chair base in response to the chair back tilting backwards; and a lumbar stimulation device located inside the chair back and attached to said flexible strap to apply pressure to the back of the user when the user leans back and the chair back tilts backwards, said chair back moving downwardly towards said chair base with respect to said flexible strap and said lumbar stimulation device attached to said strap when the user leans back and said chair back tilts backwards.

2. The chair related in claim 1, further comprising a strap attachment extending below the chair seat and coupled between the first end of said flexible strap and the chair base by which the first end of said flexible strap is attached to said chair base and the opposite end of said strap bends backwards relative to said chair base in response to the chair back tilting backwards.

3. The chair recited in claim 2, wherein the chair base includes a set of legs lying on the ground and a gas cylinder to generate a lifting force to lift the chair seat relative to the ground, said strap attachment being coupled to the chair base at the gas cylinder thereof.

4. The chair recited in claim 2, wherein said strap attachment remains stationary below the chair seat when the opposite end of said flexible strap bends backwards and said chair back moves downwardly towards said chair base in response to the user leaning back and the chair back tilting backwards.

5. The chair recited in claim 4, wherein the chair seat is connected to the chair back so that said chair seat tilts downwards towards the stationary strap attachment below the chair seat at the same time that the chair back tilts backwards, the opposite end of said flexible strap bends backwards, and said chair back moves downwardly towards said chair base.

6. The chair recited in claim 1, further comprising a rigid backing located inside the chair back between the top and the bottom thereof, said rigid backing moving downwardly with said chair back towards said chair base with respect to each of said flexible strap and said lumbar stimulation device attached to said strap when the user leans back and said chair back tilts backwards.

7. The chair recited in claim 6, further comprising at least one strap support sleeve surrounding said flexible strap and being connected to said rigid backing, said strap support sleeve sliding along said strap and moving downwardly with said rigid backing and said chair back towards said chair base when the user leans back and said chair back tilts backwards.

8. The chair recited in claim 6, further comprising a lumbar stimulation device coupler by which to connect said lumbar stimulation device to said flexible strap, and at least one wheel carried by said lumbar stimulation device coupler so as to lie against and roll on said rigid backing when said rigid backing moves downwardly with said chair back towards said chair base with respect to said flexible strap and said lumbar stimulation device attached thereto.

9. The chair recited in claim 8, wherein said at least one wheel is mounted on a wheel housing, said wheel housing being connected to said lumbar stimulation device coupler such that said flexible strap is held between said wheel housing and said lumbar stimulation device coupler.

10. The chair recited in claim 6, wherein said lumbar stimulation device includes at least one back massager located within said chair back and spaced from the rigid backing located inside said chair back to apply the pressure to the back of the user when the user leans back and the chair back tilts backwards.

11. The chair recited in claim 10, wherein said chair back also has a flexible pressure control material laying over the back massager of said lumbar stimulation device so as to engage the back of the user when the user leans back and the chair back tilts backwards, and a control shaft coupled to said flexible pressure control material to apply a pulling force to and stretch said pressure control material to cause the back of the user to be moved by said pressure control material away from said lumbar stimulation device and thereby reduce the pressure applied to the user's back by the back massager of said lumbar stimulation device.

12. The chair recited in claim 11, wherein said control shaft is held in spaced alignment with the rigid backing located inside said chair back, said control shaft being rotated in a first direction by which said pulling force is applied to stretch said flexible pressure control material and cause the back of the user to be moved away from said lumbar stimulation device, and said control shaft being rotated in an opposite direction by which a pushing force is applied to relax said flexible pressure control material and cause the back of the user to be moved towards said lumbar stimulation device and thereby increase the pressure applied to the user's back by the back massager of said lumbar stimulation device.

13. The chair recited in claim 12, wherein said flexible. pressure control material has first and opposite sides and a stiffening rod attached to one of said first and opposite sides, said stiffening rod coupled to said control shaft so that said pulling and pushing forces are applied to said pressure control material at said stiffening rod depending upon whether said control shaft is being rotated in the first direction or in the opposite direction.

14. The chair recited in claim 13, further comprising a threaded nut connected to the stiffening rod at the one side of said flexible pressure control material, said control shaft being threaded and received through and rotatable within said threaded nut so that said threaded nut moves axially along said threaded control shaft and said pushing and pulling forces are applied to said pressure control material from said threaded nut by way of said stiffening rod depending upon whether said control shaft is being rotated in said first direction or in said opposite direction and the axial direction in which said threaded nut moves along said shaft.

15. The chair recited in claim 14, wherein said threaded control shaft has first and opposite ends, the first end of said threaded control shaft being received through said threaded nut, and the opposite end of said shaft having a rotatable control knob that is rotatable back and forth to cause said threaded control shaft to correspondingly rotate in one of said first and opposite directions within said threaded nut depending upon the direction in which said control knob is being rotated.

16. The chair recited in claim 15, wherein said threaded control shaft is held in spaced parallel alignment with said rigid backing by a bracket connected between said shaft and said backing at the inside of said chair back so that said threaded nut moves axially along said threaded control shaft.

17. The chair recited in claim 15, wherein said chair back also has first and opposite sides, said rotatable control knob at the opposite end of said threaded control shaft being located outside said chair back adjacent one of the first and opposite sides thereof, and the first end of said threaded control shaft extending from said control knob to be received through said threaded nut at the inside of said chair back.

18. The chair recited in claim 1, wherein said lumbar stimulation device includes an upper roller carriage having first and opposite sides, a pivot axis running between said first and opposite sides, an it least one back massaging roller, and a lower roller carriage having first and opposite sides, a pivot axis running between said first and opposite sides, and at least one back massaging roller, said upper and lower roller carriages being spaced one above the other and rotatable independently of each other around the respective pivot axes thereof.

19. The chair recited in claim 18, wherein said lumbar stimulation device also includes a first side plate connected between the first sides of said upper and lower roller carriages, a second side plate connected between the opposite sides of said upper and lower roller carriages, and a rotatable rod coupled to said flexible strap and having first and opposite ends, the first end of said rotatable rod connected to said first side plate, and the opposite end of said rotatable rod connected to said second side plate, said rotatable rod lying between the upper and lower roller carriages so that staid upper and lower roller carriages are rotated together with said rotatable rod to enable said lumbar stimulation device to be positioned so as to conform to the shape of the back of the user.

20. A chair comprising:

a chair seat to support the weight of a user;

as chair base to hold the chair seat above the ground;

a chair back located above said chair base to support the back of the user, said chair back being coupled to said chair seat so as to tilt backwards with said chair seat relative to said chair base when the user leans back against said chair back;

a rigid backing located within said chair back;

a flexible strap having first and opposite ends and extending vertically within said chair back, the first end of said flexible strap being fixedly attached to staid chair base, and the opposite end of said flexible strap bending backwards relative to said chair base in response to the chair back and the chair seat tilting backwards; and a lumbar stimulation device located inside said chair back and having a back massager to apply pressure to the back of the user when the user leans back and the chair back and the chair seat tilt backwards, said lumbar stimulation device being connected to said flexible strap, said rigid backing moving downwardly towards said chair base with respect to said flexible strap and said lumbar stimulation device connected to said strap when the user leans back and said chair back tilts backwards.

* * * * *